US006056675A

United States Patent [19]

Aruin et al.

[11] Patent Number: 6,056,675

[45] Date of Patent: May 2, 2000

[54] KNEE AND HIP EXERCISE DEVICE AND METHOD

[76] Inventors: Alexander S. Aruin, Two Wheaton Center, #312, Wheaton, Ill. 60187; John J. Nicholas, 2141 N. Cleveland Ave., Chicago, Ill. 60614

[21] Appl. No.: 09/211,792

[22] Filed: Dec. 15, 1998

[51] Int. Cl.[7] ..... A63B 21/002; A63B 23/04

[52] U.S. Cl. ..... 482/91; 482/140; 482/145; 482/907

[58] Field of Search ..... 482/907, 142, 482/135, 121, 122, 123, 124, 125, 126, 127, 128, 129, 130, 148, 140, 91, 143–145, 904; 601/23, 34, 35

[56] References Cited

U.S. PATENT DOCUMENTS

| | | | |
|---|---|---|---|
| 4,373,716 | 2/1983 | Pagani | 482/130 |
| 4,483,533 | 11/1984 | Mangiapane . | |
| 5,031,906 | 7/1991 | Jang . | |
| 5,137,504 | 8/1992 | Mangini | 482/131 |
| 5,399,138 | 3/1995 | Jones | 482/127 |
| 5,492,524 | 2/1996 | Marx | 482/112 |
| 5,674,164 | 10/1997 | Kravitz | 482/126 |
| 5,690,594 | 11/1997 | Mankovitz | 482/121 |
| 5,697,873 | 12/1997 | Van Straaten | 482/126 |
| 5,807,217 | 9/1998 | Endelman | 482/122 |

*Primary Examiner*—John Mulcahy

[57] ABSTRACT

An exercise device particularly adapted for an isometric workout of lower body muscles includes a seating plate. Releasably attached to a front wall of the seating plate is a fixed bar. Then, pivotally attached respectively to top and bottom ends of the fixed bar are inner ends of upper and lower movable support members. On an outer end of the upper support member is a fastener. This fastener includes a pin for selective insertion in one of a set of spaced apart holes in an outer end of the lower support member to join the member ends. Finally, a sleeve-type fastener of a leg engaging member is slidably disposed on the upper support member. Leg engaging member positioning is secured by a further pin insertable in one of a set of holes in an outer end of the upper support member. The leg engaging member includes a pair of padded ends piece spaced apart by a transversely positioned middle padded piece. Contact discs of the end pieces abut the middle padded piece. For use the seating plate is placed on a chair, for example. A user then sits of the plate and positions his legs on the adjustably positional leg engaging member to undertake isometric leg flexion, leg extension, leg abduction, and leg adduction exercises.

4 Claims, 6 Drawing Sheets

KNEE AND HIP EXERCISE DEVICE AND METHOD

FIELD OF THE INVENTION

This invention is relative to a device for exercising either one or both legs of a user. More specifically, it relates to an exerciser that permits a patient or an athlete to exercise the muscles of the knee joint by performing flexion-extension movements and muscles of hip joint by performing adduction and abduction movements while being seated.

BACKGROUND OF THE INVENTION

Circulatory problems in the lower extremities are frequently seen in elderly people. These problems, sometimes precipitated by diabetes, may lead to a below-knee amputation. Following a below-knee amputation, individuals are confronted with the necessity to literally learn anew how to walk using prosthetic devices. However, using a prosthesis requires substantial strength and endurance of the proximal muscles of the residual limb and the lower trunk. Young people are more likely to possess such strength and/or to be able to develop them quickly with exercise. This is not so likely in cases of amputation in elderly individuals in whom weakness of the residual leg muscles is frequently a limiting factor that may not be amenable to exercise.

Patients after a below-knee amputation, especially the elderly, have been documented to demonstrate remaining muscle atrophy and weakness even after complete rehabilitation (Renstrom et al., 1983; Klingenstierna et al., 1990). On the other hand, it has been shown that strength of the knee extensors may be increased with special exercise (Klingenstierna et al., 1990).

Doctors, physical therapists, and athletic trainers suggest a variety of different exercises to strengthen the lower limbs and to increase the force of knee and hip muscles. Various techniques and devices have been designed to provide such exercises. However, most of these devices require a patient or an athlete to maintain a vertical posture, or to visit a gym, which is difficult for example, for an elderly person, disabled person, or a person with a leg amputation. Besides that, many patients with, for example, arthritis can not use regular devices because of joint pain during regular exercises.

When the full range of motion in the joint can not be performed because, for example, pain, isometric exercises are helpful in increasing of muscle force without moving the joint.

The present invention is intended to provide an exercise device for increasing the force of leg muscles that overcomes the problems as set forth above. The recognized benefits of the present invention are in minimizing joint compression and shearing forces by using isometric exercises. Isometric contractions for rehabilitation or physical therapy or conditioning, especially in cases of painful joints or after a joint has been fully or partially immobilized due to disease or surgery provide a means of exercise without joint motion. This is particularly important for users with impaired, e.g., painful or arthritic knee joints, or the elderly.

The device may be used at the hospital, home, health club, office, school gym, or outdoors, depending upon the purposes and result desired. It occupies relatively little space and can be operated quietly.

A number of devices are known which may be used in the performance of knee exercises. U.S. Pat. No. 4,727,860 that provides for movement about three axes that correspond to and are coaxial with the knee joint axes of flexion/extension, tibial rotation and abduction/adduction.

Another type of exerciser device includes straps attached to elastic members wherein the user's foot is firmly grasped, and the device is held in place by the user attaching it to the back of a chair with the user sitting in said chair and moving his/her knee against the tension created by the elastic member (U.S. Pat. No. 4,478,414, U.S. Pat. No. 4,844,454). However, such devices can not provide isometric exercises.

A further type of exerciser provides movements of the boards when the user puts his feet on boards (U.S. Pat. No. 4,862,875). However, such a device does not allow a user to provide isometric contraction of muscles.

Another type of exerciser device has been disclosed which is attached to the limb of the user and the position of the biasing member can be changed between a first position and a second position directly opposed to the first position, thereby providing a resistive force against which different muscles of the limb work (U.S. Pat. No, 5,013,037). However, such a device has to be attached to the user's limb. This is not possible in the case of amputation.

Another type of exerciser device has been developed which is designed to exercise abductor/adductor leg muscles. The device is based on applying force against the tension created by the elastic member (U.S. Pat. No. 5,480,367) or cabled weight assembly (U.S. Pat. No. 5,562,578). However, such devices do not provide isometric training of leg muscles.

For background purposes and as an indicator of the state of the art to which the invention relates references may be made to the following remaining patents found in the search: U.S. Pat. No. 5,324,241, U.S. Pat. No. 5,284,131, U.S. Pat. No. 4,784,121, U.S. Pat. No. 5,575,743.

Other References

Klingenstierna U, Renstrm P, Grimby G, Morelli B. (1990) Isokinetic strength training in below-knee amputees. Scand J Rehab Med 22: 39–43.

Renstrom P, Grimby G, Gustavsson E. (1983) Thigh muscle strength in below knee amputees. Scand J Rehab Med 15, Suppl. 9: 163–173.

Therefore a need exists for a leg exerciser that has the versatility to enable a user to produce a broad range of knee and hip, exercise isometrically on patients who have lost part of their leg.

The present invention can provide a wide spectrum of exercises with a different range of angles in the knee and hip joints. The device may be easily adjusted to variations in size, age, medical conditions, and training level of the individual.

The present invention can furnish an isometric type of muscle contraction, which provides an exercise effect on the knees and hips; it causes the muscles in the legs to flex and contract; it may tend to strengthen and develop these muscles after only a relatively short period of practice.

The present device can be used for training of elderly and disabled people, rehabilitation of injured knee and hip joints, and fitness and body fat reduction programs and for patients with residual limbs following amputation.

OBJECTIVES

It is the object of this invention to design a simple apparatus to provide isometric exercises for knee flexors or extensors, and hip abductors or adductors in either or both legs of a subject, minimizing compressive forces in the joint.

It is also an object of this invention to provide a method of exercising of leg muscles while minimizing joint shear forces.

It is also an object of this invention in which such apparatus provides self-operable knee and hip therapy.

It is also an object of this invention in which such apparatus can be positioned on the patient's bed or couch or on a chair providing leg exercises in familiar environment for those who cannot attend rehabilitation facilities or a regular gym.

It is also an object of this invention in which such apparatus provides variety of isometric exercises in either or both knees and hips of the user.

It is also an object of this invention in which such apparatus provides variety of isometric exercises for people with leg amputation.

It is also an object of this invention that such apparatus is positioned under the user's pelvis and is supplied with handles to give additional support to the user.

It is also an object of this invention that such an apparatus is lightweight and is hand portable.

SUMMARY OF THE INVENTION

Related objects and advantages of the present invention will become even more apparent by reference to the following figures and detailed description in which similar reference characters refer to similar parts:

DESCRIPTION OF PREFERRED EMBODIMENTS

Figure 1:
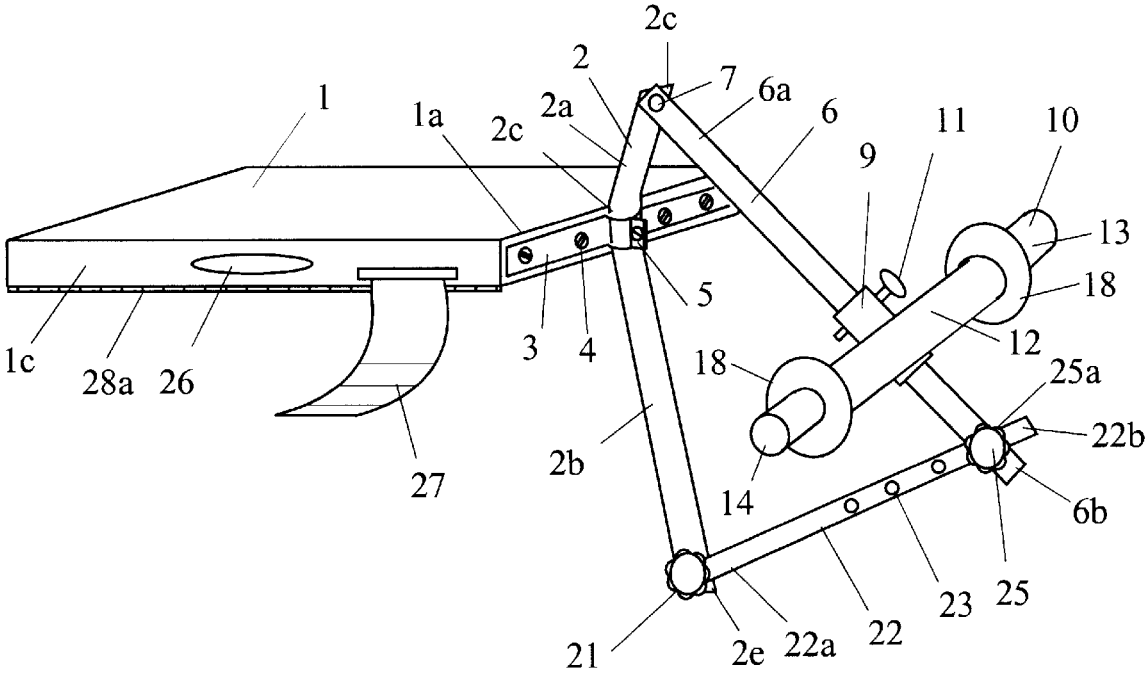
FIG. 1 is a perspective view of a knee and hip exercise device embodying the present invention.
Figure 2:
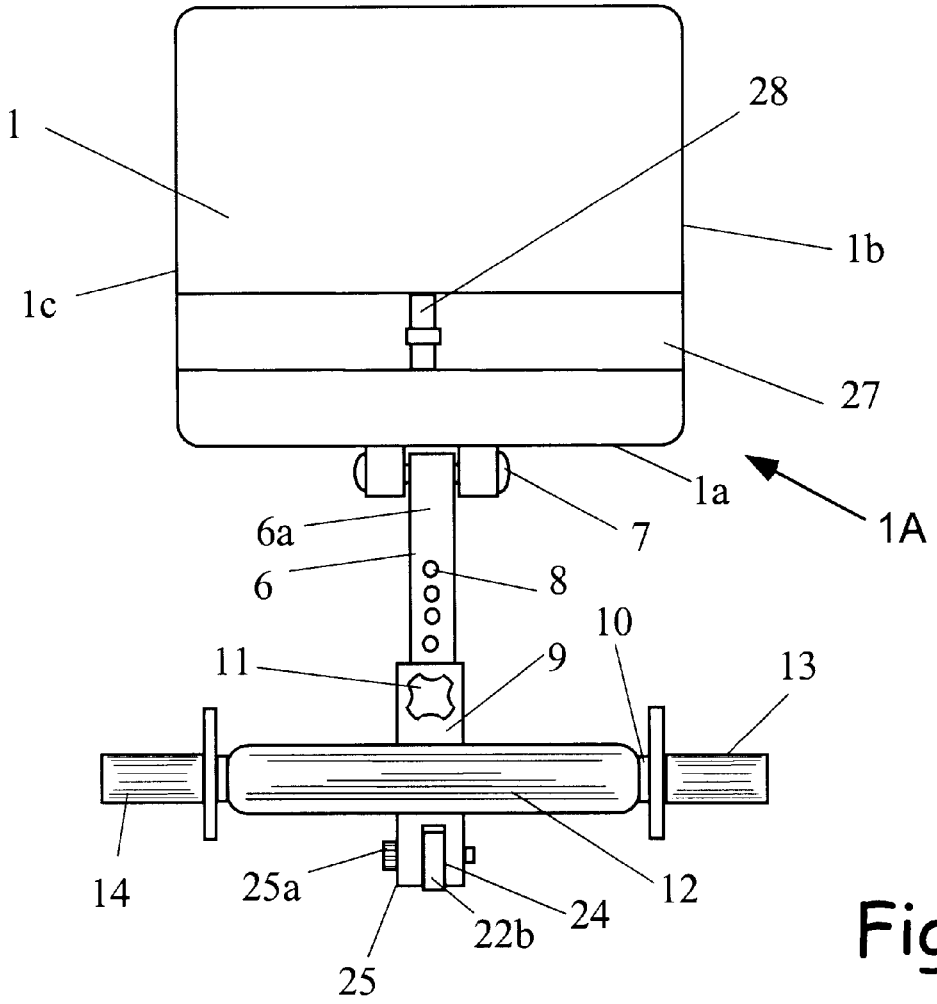
FIG. 2 is a top plan view of a knee and hip exercise device of FIG. 1.
Figure 3:
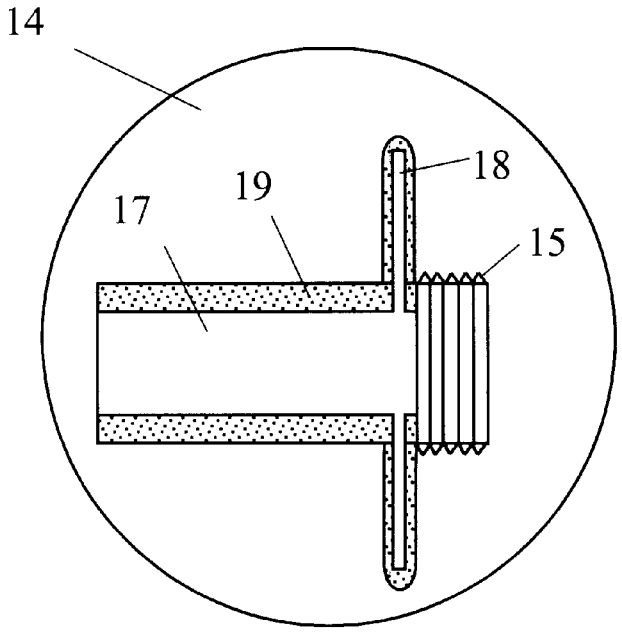
FIG. 3 is a detailed representation of an end piece of a leg engaging member of the device (14) of FIG. 1.
Figure 4:
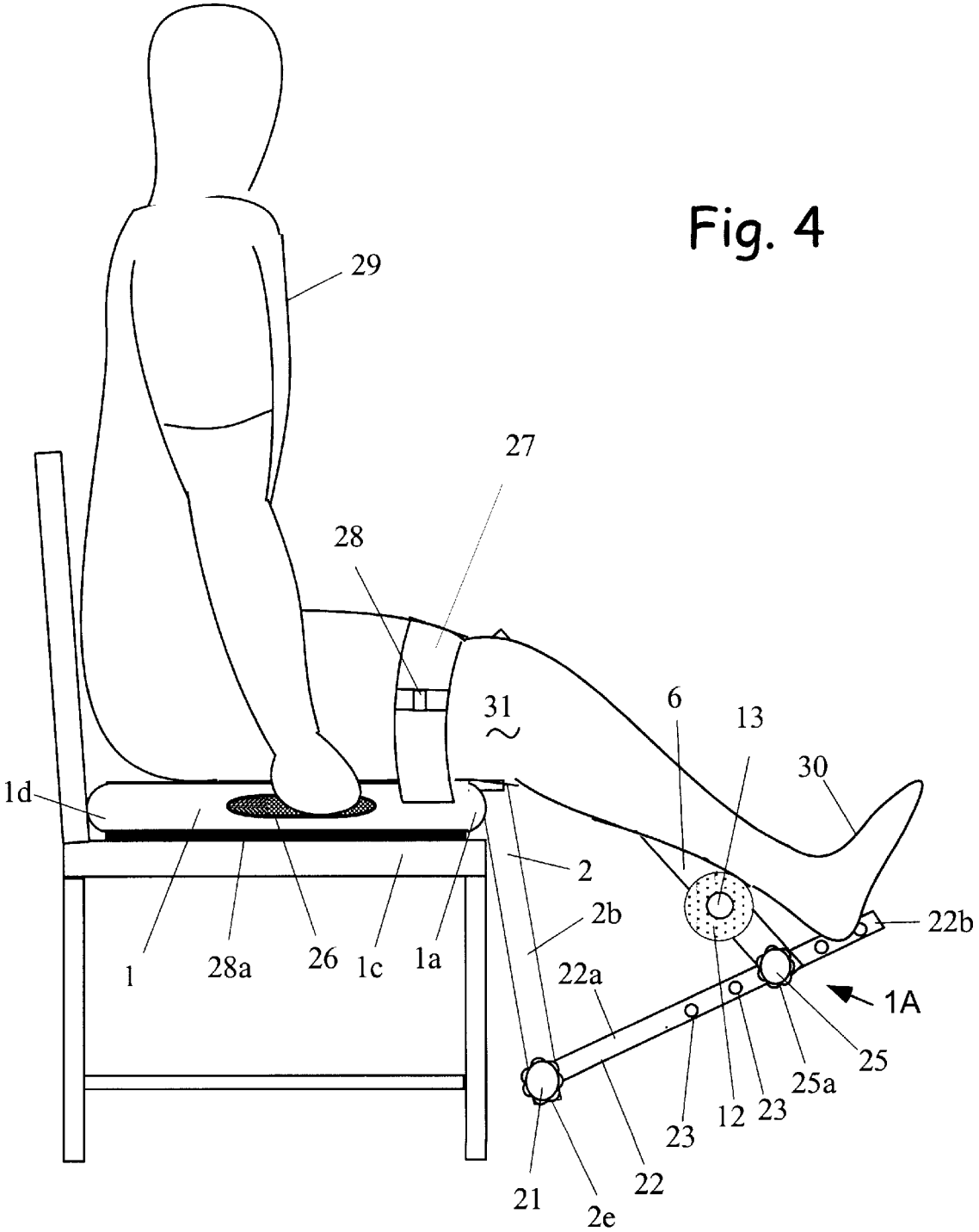
FIG. 4 is a schematic representation of the knee and hip exercise device of FIG. 1 as used to exercise knee flexion muscles.
Figure 5:
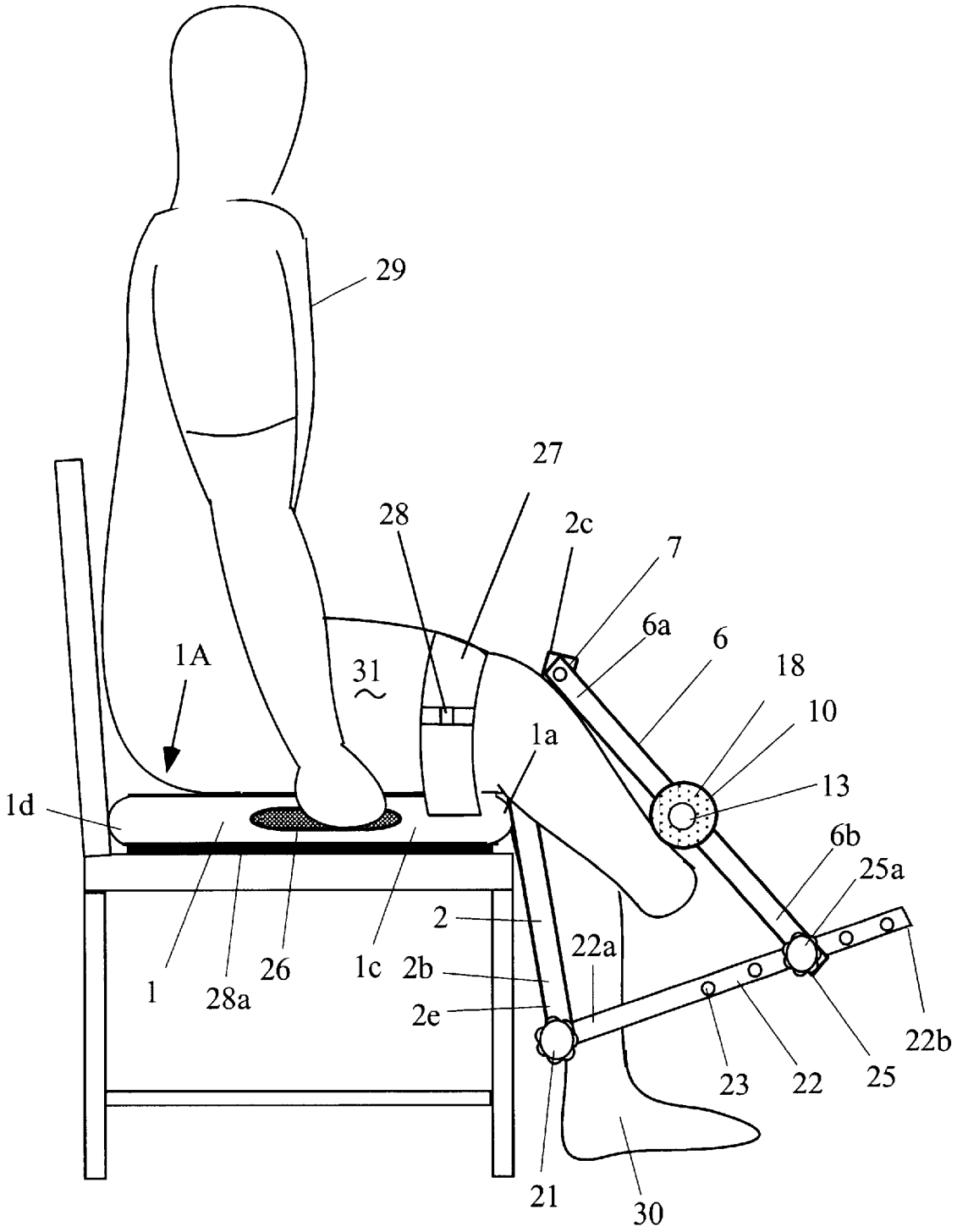
FIG. 5 is a schematic representation of the knee and hip exercise device of FIG. 1 as used to exercise knee extensor muscles.
Figure 6:
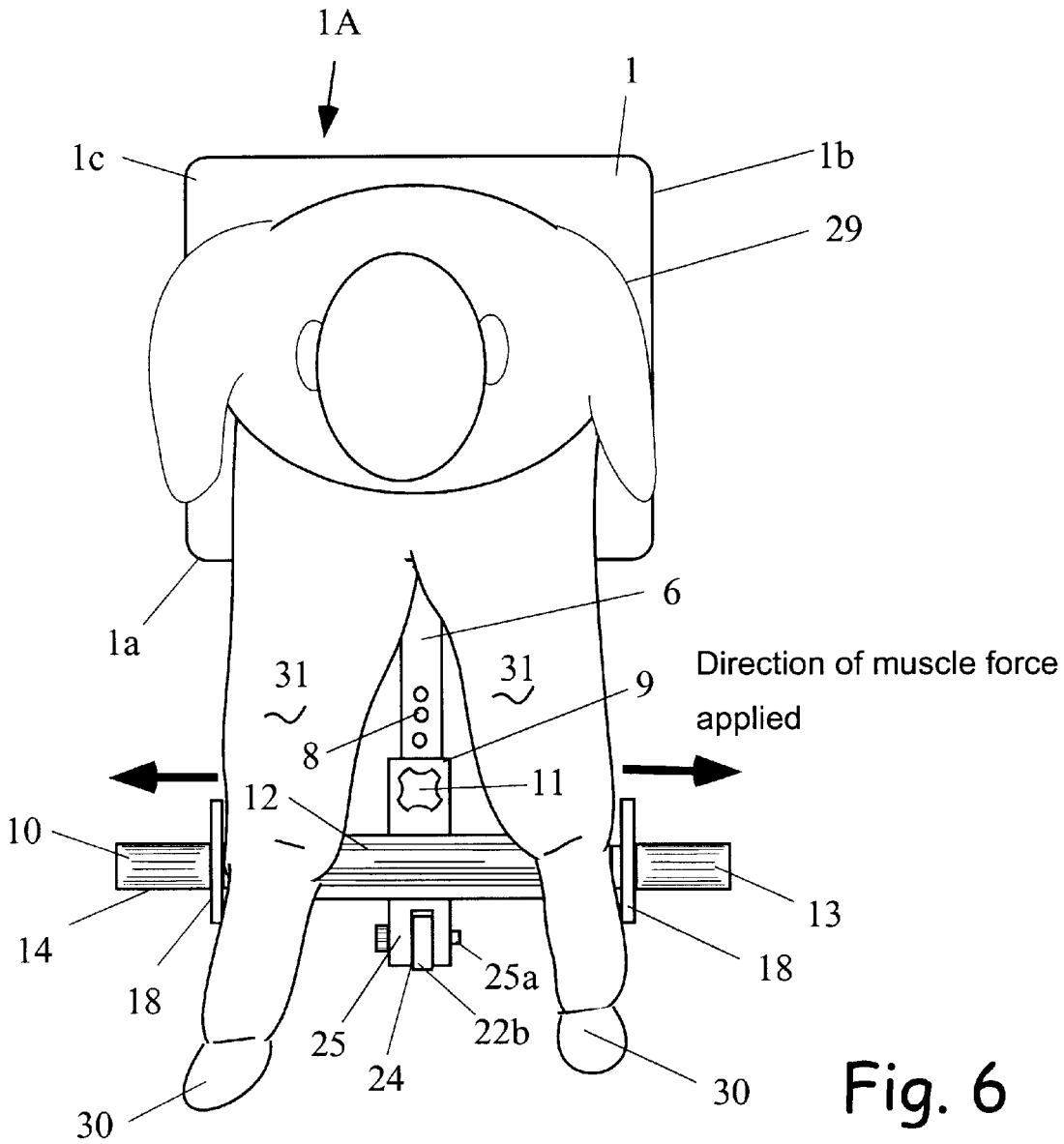
FIG. 6 is a schematic representation of the knee and hip exercise device of FIG. 1 as used to exercise hip abduction muscles.
Figure 7:
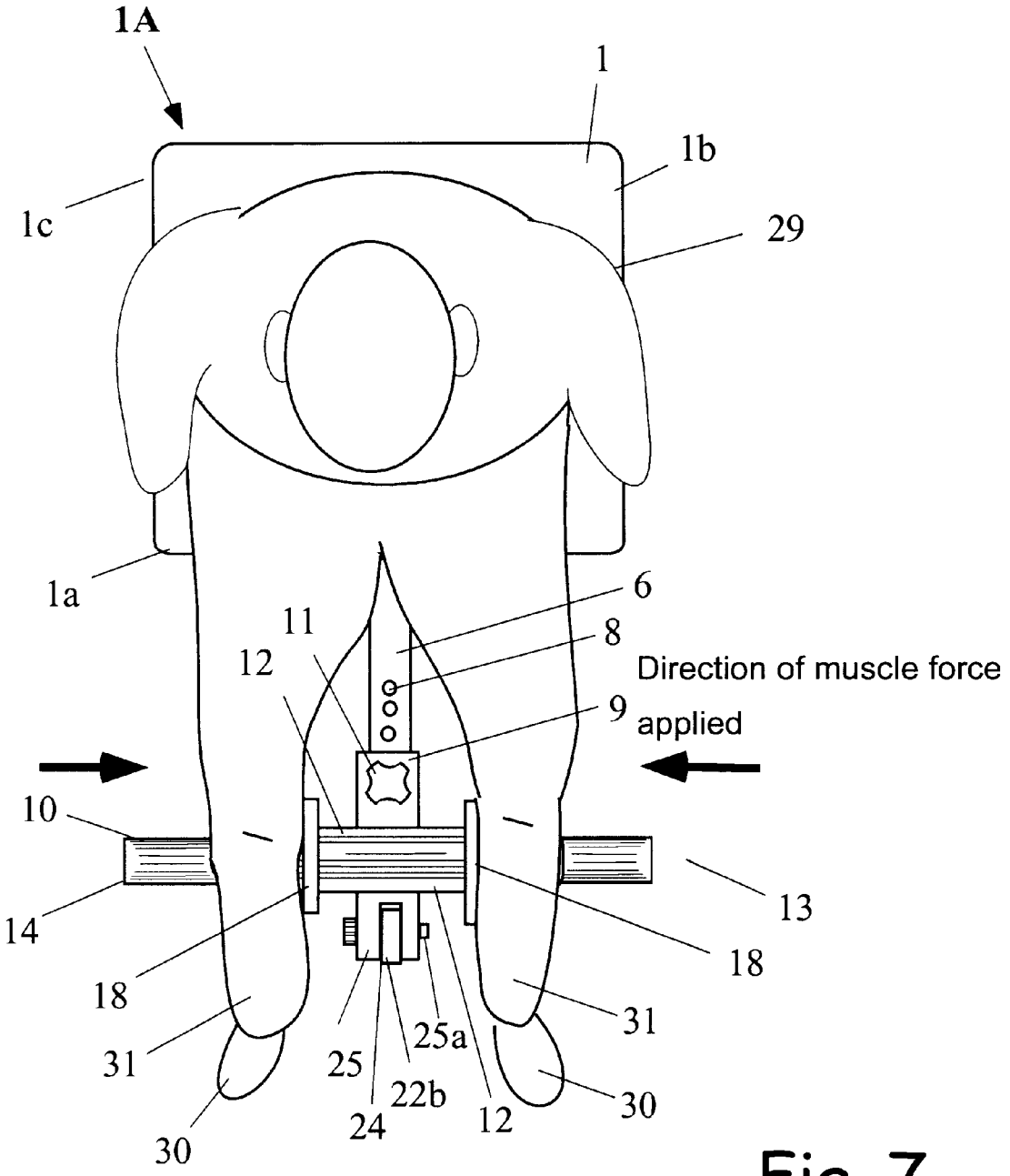
FIG. 7 is a schematic representation of the knee and hip exercise device of FIG. 1 as used to exercise hip adduction muscles.

An isometric exercise device is shown generally in FIGS. 1 and 2 and designated (1A). The device (1A) includes a seating plate (1). Attached by bolts (4) to a front wall **(1*a*) of the seating plate (1) is a mounting plate (3). The device (1A) further includes a fixed bar (2) defined by angularly offset upper and lower sections (2*a*) and (2*b*) joined to a middle segment (2*c*). The fixed bar middle segment (2*c*) then is attached to the seat mounting plate (3) by a clamp (5). An inner end (6*a*) of an upper movable support member (6) is attached to a top end (2*d*) of the fixed bar upper section (2*a*) by a pin (7). A set of spaced apart holes (8) is provided at the upper support member (6) for positioning a sleeve-type fastener (9) of a movable leg engaging member (10). The position of the leg engaging member (10) on the upper member (6) is maintained by a pin (11) inserted into one of the holes (8). As best shown in FIG. 2, the leg engaging member (10) includes a middle padded piece (12). The middle padded piece (12)** is designed to be pushed by either one or both legs of the user, is smooth and preferably is covered with a relatively soft material, for example, foam rubber.

The leg engaging member (10) has a pair of end pieces (13) and (14). The end pieces (13, 14) are secured by a threaded inner end (15) of each end pieces (13,14). Each end piece (13,14) has an outer sleeve (17) and a contact disc (18). The outer sleeves (17) and contact discs (18) are covered with soft material (19), for example foam rubber; The end pieces (13 and 14) are adapted to be pushed by either one or both legs of the user.

Pivotally attached to a bottom end **(2*e*) of the fixed bar lower section (2*b*) is an inner end (22*a*) of a lower movable member (22). In an outer end (22*b*) of the lower member (22) is a set of spaced apart holes (23)**.

On an outer end **(6*b*) of the upper member (6) is a cleat-type fastener (25) having a slot (24). Disposed in this slot (24) is the lower member outer end (22*b*) where held by a pin (25*a*) inserted into one of the lower member holes (23). The position of the lower movable member (22) in the slot (24) fixes the position of the upper support member (6) relatively to the fixed bar (2) and seating plate (1). Accordingly, moving the lower movable member (22)** to a new position will change the knee angle during exercising.

The combination of the figured bar (2), support member (6) with rigid member (22) could be disconnected from the plate (1) by releasing the clamp (5). Therefore, the device 1A is capable of being stored with a minimum space requirement.

The seating plate (1) includes a pair of handles (26) attached respectively to right and left sidewalls **(1*b*, 1*c*) of the plate (1) and a belt (27) with a buckle (28) to insure a proper position of the user during exercising when it is necessary. The seating plate (1) is covered with a soft material adjustable to the shape of the body of the user, such as foam rubber and a fabric. The mounting plate (3)** is also covered with a soft material.

A bottom wall of the plate (1) is provided with antislippery elements **(28*a*), for example, Velcro tape. These elements (28*a*) prevent the knee and hip exercise device 1A** from sliding on a chair, bench or sofa, etc.

Although we believe that the operation of the leg exerciser device 1A is apparent from the above discussion, the operation will now be briefly described.

Referring to FIGS. 4–7, exercises are performed after placing the device 1A on the seat of a chair, or on the bed, the couch, or the lounge. The user (29) positions himself on the seating plate (1), buckles the belt (27) using the buckle (28) and activates muscles to be exercised against the middle padded piece (12) of the leg engaging member (10) the outer sleeves (17) or contacts discs (18) of the end pieces (13,14). Optionally, the user (29) may hold on to the handles (26) providing better position for the body. A foot or feet (30) of the user (29) will be resting comfortably on the floor prior to the start of the exercise.

Generally four different types of exercises will be performed: knee flexion, knee extension, hip adduction, and hip abduction. While performing exercises, one leg (31) (or both legs) will be touching the middle padded piece (12) or end pieces (13, 14), applying force against padded piece (12) or pads (13, 14). Because the position of the leg engaging member (10) is adjustable relative to the length of the upper movable support member (6), any person, including those with below-knee amputation (even those with above-knee amputation), can use the device (1A). While exercising knee flexors (FIG. 4), the user (29) puts one or both legs (31) on the leg-engaging member (10) and applies isometric force against the upper surface of the padded piece (12). While exercising knee extensors (FIG. 5), the user (29) puts legs

(31) under the leg-engaging member (10) and applies force against the lower surface of the padded piece (12). While exercising the hip abductors (FIG. 6), the user (29) positions his legs 31 against the contact discs (18) of the end pieces (13 and 14) and applies force against the contact discs (18) outwardly. While exercising the hip adductors (FIG. 7), the user (29) puts legs (31) against the contact discs (18) of the end pieces (13 and 14) and applies isometric force inward on the contact discs (18).

It is to be further understood that combinations of any types of exercises are available using the device (1A), e.g., simultaneous knee flexion and hip adduction, hip adduction and knee extension, knee flexion, and hip adduction, etc., so the user (29) could exercise two muscle groups increasing the effect of therapy.

It is to be further understood that different positions of the leg engaging member (10) with respect to the user's body, as well as different positions of the end pieces (13,14) of the leg engaging member (10), can be used in exercising the leg muscles. These will produce different therapy and training effects. It is also to be further understood that the use of isometric knee flexion-extension exercises as well as hip adduction-abduction exercises will produce a variety of exercising effects, depending on the combination of angles between the fixed bar (2) and the upper movable support member (6).

The user (29) could progressively increase the range of knee flexion (or extension) or hip adduction (or abduction) to an extent, which is consistent with the stage of his/her conditioning or rehabilitation.

The device (1A) can be used while lying on a bed. This is particularly important for patients in the early stage of rehabilitation.

The device (1A) is easy to use and is adjustable to variations in age, size, and medical condition of the individual. The device (1A) provides an efficient way of exercising leg muscles.

We claim:

1. An isometric knee and hip exercising device comprising:

a seating plate prepared for being carried by a chair and positioned under a user's buttock and having fastening elements to secure a position of a body of said user to said seating plate, a fixed bar removably connected to a front wall of said seat, an upper movable support member having an inner end pivotally connected to a top end of said fixed bar, a lower movable support member having an inner end pivotally connected to a bottom end of said fixed bar and an outer end joined by an adjustable pivot connection to an outer end of said upper support member, said lower support member having spaced apart holes for said adjustable pivot connection to form a variety of angles between said upper support member and said lower support member, said upper support member carrying a movable sleeve member of a leg engaging member prepared to be pushed or pulled by either one of both legs of said user, said leg engaging member having a pair of end pieces spaced apart by a middle padded piece with respective contact discs of said outer pieces abutting ends of the middle padded piece, and wherein said spaced apart holes of said lower movable support member allow said upper support member, said lower support member, and said leg engaging member movably carried by said upper support member to provide said user with a variety of positions of said leg engaging member for efficient exercising knee and hip muscles.

2. An isometric knee and hip exercise device as defined by claim 1 and further characterized by, said fastening elements to secure the position of said user to said seating plate comprise handles attached to respective sidewalls of said seating plate.

3. An isometric knee and hip exercise device as defined by claim 1 and further characterized by, said middle padded piece and said outer pieces of said leg engaging member being covered with a soft adjustable material.

4. An exercise device particularly adapted for providing isometric exercise of lower body muscles of a user, said device comprising:

a seating plate prepared to be carried on a support surface of a piece of furniture, a fixed bar having angularly offset, vertically positioned upper and lower sections joining to form a middle segment attached to a front wall of said seating plate, an upper movable support member having an inner end pivotally connected to a top end of said fixed bar upper section, a lower movable support member having an inner end pivotally attached to a bottom end of said fixed bar lower section, a cleat-type fastener carried on an outer end of said upper support member, a set of spaced apart holes in said lower support member for selecting joining an outer end of said lower support member to said upper support member cleat fastener, and a leg engaging member having a sleeve-type fastener disposed on said upper support member for selective insertion of a pin of said sleeve fastener in one of a set of spaced apart holes in said upper support member, a middle padded piece transversely attached to said sleeve fastener, and padded end pieces carried by said middle padded piece, said end pieces including respective outer sleeves and contact discs abutting said middle padded piece, wherein a vertical and a horizontal distance between said seating plate and said leg engaging member may be adjusted by selective attachment of said lower support member outer end to said upper support member cleat fastener and by selective attachment of said leg engaging member sleeve to said upper support member to allow said user to customize contact points for application of upward, downward, outward and inward upper leg and lower leg forces on said leg engaging member.

* * * * *